United States Patent [19]

Ondrasik

[11] Patent Number: 4,821,885

[45] Date of Patent: Apr. 18, 1989

[54] STACKABLE AND NESTABLE BASKET DEVICE

[76] Inventor: V. John Ondrasik, 11215 S. Wilmington, Los Angeles, Calif. 90059

[21] Appl. No.: 937,079

[22] Filed: Dec. 1, 1986

[51] Int. Cl.[4] ..... B65D 21/04; B65D 21/02; B65D 6/08

[52] U.S. Cl. ..... 206/513; 246/505; 246/510; 220/19

[58] Field of Search ..... 206/505, 510, 513; 220/19

[56] References Cited

U.S. PATENT DOCUMENTS

| | | | |
|---|---|---|---|
| 2,364,705 | 12/1944 | Geralds | 206/510 |
| 2,554,232 | 5/1951 | Young, Jr. . | |
| 2,646,186 | 7/1953 | Russell | 206/510 |
| 2,662,662 | 12/1953 | Moorhead . | |
| 2,736,453 | 2/1956 | Russell . | |
| 2,923,432 | 2/1960 | Stanley | 220/19 |
| 3,022,900 | 2/1962 | Averill . | |
| 3,037,658 | 6/1962 | Schray | 206/513 |
| 3,082,879 | 3/1963 | Wilson . | |
| 3,338,466 | 8/1967 | Hare et al. . | |
| 3,378,161 | 5/1968 | Lookabaugh . | |
| 3,524,565 | 8/1970 | Wilson . | |
| 3,704,791 | 12/1972 | Young, Jr. . | |
| 4,146,139 | 3/1979 | Stein et al. . | |
| 4,298,127 | 11/1981 | Upshaw et al. . | |
| 4,431,408 | 2/1987 | Postich . | |

FOREIGN PATENT DOCUMENTS

| | | | |
|---|---|---|---|
| 1381379 | 11/1964 | France | 206/513 |

*Primary Examiner*—George E. Lowrance

*Attorney, Agent, or Firm*—Brown, Martin, Haller & McClain

[57] ABSTRACT

A basket suitable for stacking and nesting with like baskets comprising a substantially rectangular shaped frame having arches affixed to both edges of the frame and extending above and below the frame, a gripper bar affixed near, and extending across, the feet of the arches for stacking the baskets, and support bars spanning the width of the frame uplifted at one end and affixed thereto at both sides thereby defining the bottom.

10 Claims, 2 Drawing Sheets

STACKABLE AND NESTABLE BASKET DEVICE

BACKGROUND OF THE INVENTION

The invention described herein corresponds to a basket suitable for being stacked with like baskets upon a desk, cabinet and the like, for holding documents, papers, computer printouts, letters, or correspondences generally. Moreover, the baskets can be disassembled and easily stored in a nested arrangement.

The prior art shows various trays, receptacles, and the like wherein they are stacked one upon the other. A variety of mechanisms have been employed to enable the trays to be stacked. Such include fastening devices independent of the tray, or fastening means integrated into the tray, which allow trays to be releasably stacked, and disassembled for storage. It is apparent that independent fastening means are not preferred because they become easily misplaced and lost. For the most part, securing or fastening means that are integral to the tray also are not preferred because by securing the trays together the fastening means subject the trays to stresses which eventually result in deterioration of the tray.

U.S. Pat. No. 2,554,232 describes a tray having a bottom and upstanding rear and sidewalls. Center braces form the sidewalls and consist of rings mounted against outer surfaces thereof. The center braces, and front and rear braces, grip the support means of a second tray of duplicate construction thereby holding the second tray in place.

U.S. Pat. No. 2,662,662 describes like baskets, having two piece frames, capable of being stacked or nested. The upper frame of the lower basket, having offset portions exhibiting the structure of a handle, is engagable with a loop structure associated with the lower frame of the upper or stacked basket.

U.S. Pat. No. 2,736,453 shows yet another means whereby baskets of similar design are stacked. This patent provides for stacking baskets having one or more guide rails, or runners, adapted to rest upon the handle portion of a basket situated beneath it thereby allowing the upper basket to slide into registration with the lower basket.

A further means whereby baskets of similar design can be held in a stacked relationship by a non-integral fastening device is shown in U.S. Pat. No. 3,022,900. Therein are shown stacking lugs situated as independent fastening means allowing for a locking arrangement of the upper and lower baskets. A similar design is seen in U.S. Pat. No. 3,338,466 where therein are shown baskets having upright walls that provide seats for similar baskets allowing for vertical alignment of the stacked baskets.

Examples whereby the gripping, fastening or stacking mechanism is an integral part of the tray is shown in U.S. Pat. No. 3,524,565. Therein is shown a basket having upper portions exhibiting a wire loop. A second basket of similar design also exhibits corresponding horizontal wire loops apparent at the corners of its bottom, and in respective alignment with the upper loop projections of the first basket. Thus, the trays are stacked by placing their horizontal bottom loops over the upstanding upper loops of the lower receptacle.

Another example of an integral fastening means is revealed in U.S. Pat. No. 3,704,791. Therein is shown a support, or stand, comprising part of a tray. The support serves as a brace for the sides of the tray and moreover, having a flared outward projection from the plane of the sides of the tray allows for trays to be stacked one upon the other.

Lastly, U.S. Pat. No. 4,298,127 shows a snap-fitting mechanism allowing for releasable stacking and interlocking of multiple baskets.

SUMMARY OF THE INVENTION

An improved stackable and nestable basket for holding or displaying letters, correspondences, general computer printouts and the like. The baskets are stackable and nestable with like baskets, occupying a small amout of space when stacked, are easily disassembled and easily stored.

The basket has a predominantly rectangular shape, having arches attached at both ends which extend both above and below the frame. The fore and aft parts of the arch, beneath the frame, support the frame and additionally have affixed thereto a gripping bar. In the stacked arrangement, the topmost region of the arches, on the lower basket, are received between the frame and gripping bar of the upper baskets. In this fashion the baskets are held firmly in place.

In addition to serving a support and gripping function, the raised portion of the arches that extends above the frame acts as a barrier to prevent overflow of correspondence, computer printouts and the like, held by the basket.

The frame of the basket is crossed with support means that are affixed to both the front and back of the frame. A feature of the support means is that it is constructed so that the top and front are open, thereby allowing for easy ingress and egress of items placed in the basket. Further, at the back of the basket, the support means extend upwardly forming a barrier that substantially prevents egress of materials therethrough.

An additional feature associated with the novel stacking means is that the baskets can be stacked so that the lower and upper baskets face opposite each other and, therefore, two users can simultaneously input materials into the basket, such as might arise in a situation where individuals occupy a common desk with the baskets positioned thereon.

The construction of the basket allows for rapid disassembly and nesting. The latter feature considerably minimizes the amount of space needed to store the baskets. For nesting, it is merely necessary to disengage the arches engaged between the gripping bar and the frame, shift the upper basket slightly in a longitudinal horizontal direction with respect to the lower basket and drop the upper basket into the lower basket.

The baskets can be constructed of a variety of materials, metals, wood and plastic being preferred. However, because of the rough day-to-day handling that the baskets will encounter, it is anticipated that most often they will be constructed of metal. The constructional aspects of the baskets are such that they can be manufactured at a relatively low cost, whereby the component parts are affixed by welding, gluing, or otherwise attached.

A more detailed explanation of the invention is provided in the following description and appended claims taken in conjunction with the accompanying drawings.

DETAILED DESCRIPTION OF THE INVENTION

Figure 1:
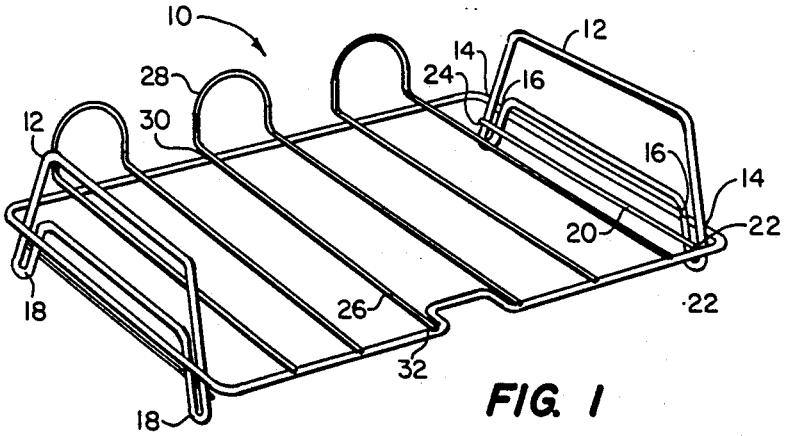
FIG. 1 is a top perspective view of a stackable-nestable basket constructed in accordance with the concepts of the present invention.

FIG. 1 of the drawings illustrates a portable stackable and nestable basket having a first wire rod 10 which extends in a continuous near rectangular loop around the periphery of the basket. Respective wire loops formed as arched wire rods 12, each having an uplifted region 13, are perpendicularly affixed to respective edges of the frame 10 at respective locations 14 and 16. In this manner, the arches 12 extend both above and below the frame 10. The region below the frame 18 acts as feet with which to support the frame. It will be appreciated that while the arches 12 shown in FIG. 1 are affixed to the inside of the frame 18, that they can also be positioned and affixed at locations 14 and 16 but to the outside of the frame.

The arches 12 located at both edges of the frame 10 serve several functions. First, they provide a convenient means whereby the racks can be handled; second, the feet region of the arches 18 permits the basket to be elevated up off a surface; and third, the region of the arch below the frame in cooperation with a gripper bar 20 acts as a means whereby the baskets can be securely stacked. The gripper bar 20 associated with the arches 12 at both edges of the frame is affixed to the arches at positions 22 and 24. It can be affixed using a wide number of techniques, particularly welding, gluing and the like.

A plurality of spaced and parallel wire rods 26 extend across the width of the frame formed by the wire rod 10. The wire rod 26 constitutes a bottom support element for the basket. A particularly favored construction of the wire rods 26 are rods having an upwardly shaped loop 28 that defines the rear of the basket. The loops 28 also act as a barrier to prevent papers, correspondences, computer programs and the like from sliding out of the basket. The parallel wire rods 26 are respectively affixed to the frame 10 at, for example, points 30 and 32. At these points, the rods 26 are affixed, either by welding, gluing or other similar means.

Figure 2:
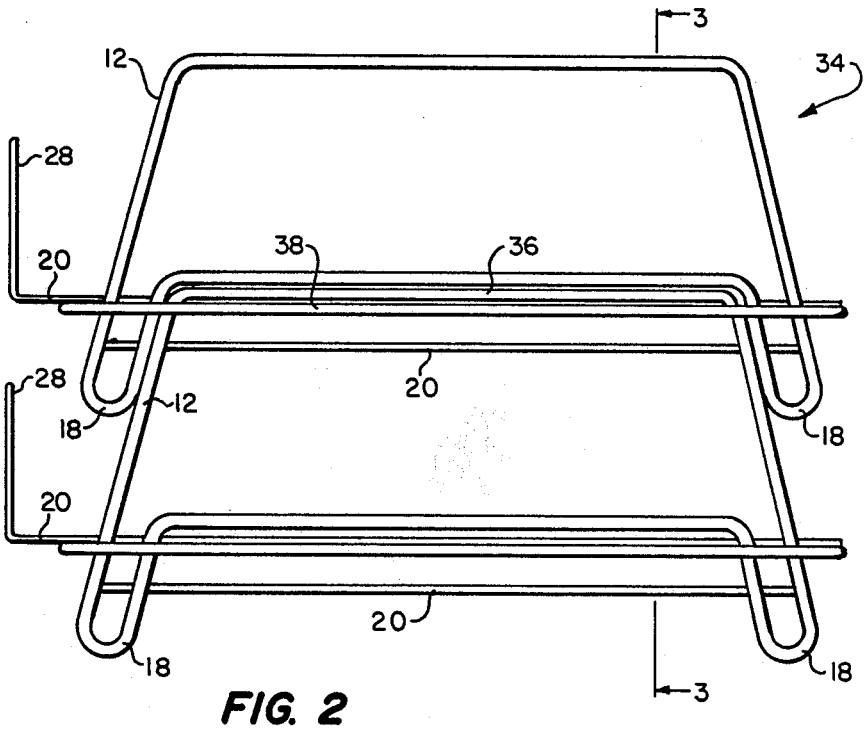
FIG. 2 is a side elevational view of a plurality of baskets constructed in accordance with the invention. This view illustrates the baskets stacked in a tiered relationship.

FIG. 2 shows an end view of two baskets in a tiered stacked relationship with respect to one another. The gripping bar 20, and the arch 12 of the top basket 34, receive the arch 36 of the bottom basket such that arch 36 is engaged between the gripping bar 20 and the frame end 38. It will be appreciated that the uplifted region 13 of the arch 12 provides a space for receiving the arch of the bottom basket 37. The bottom basket 37 then supports the top basket 34 by contacting with the uplifted region 13.

Figure 3:
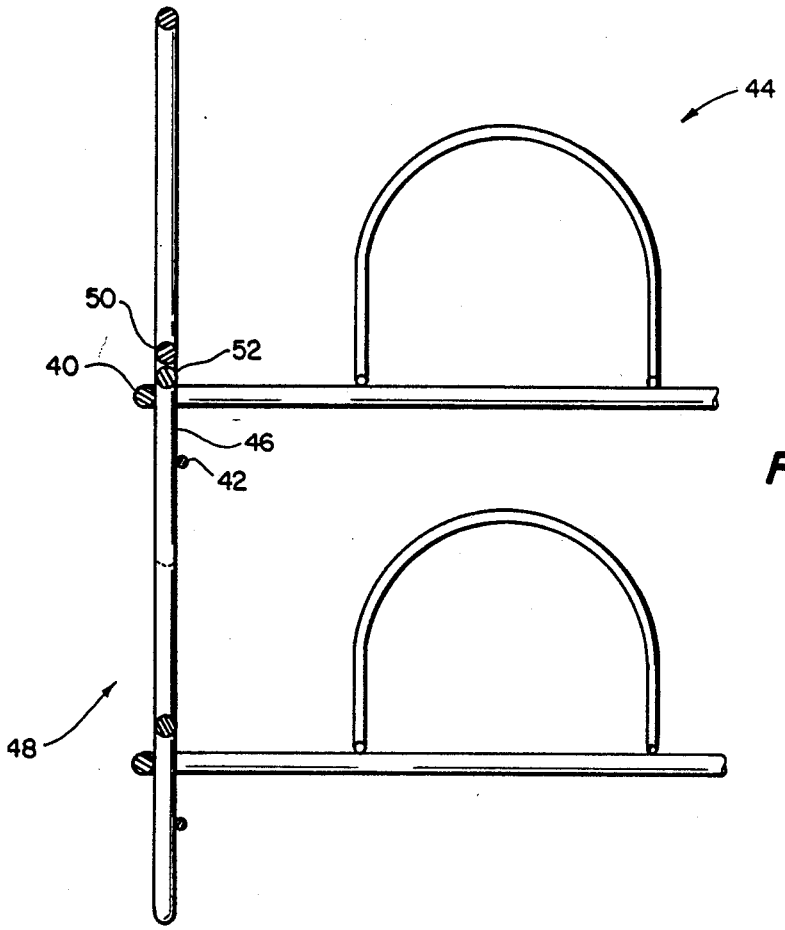
FIG. 3 is a sectional view of FIG. 2, showing the manner in which one basket may be stacked on top of another.

FIG. 3 shows a fragmentary cross-sectional view of two baskets in a stacked tier configuration, one on top of the other. The frame 40 and the gripper bar 42 associated with the upper basket 44 is shown receiving the arch 46 of the lower basket 48. The arch 50 of the upper basket 44 contacts the arch 52 of the lower basket 48 when the baskets are in the stacked postion. In this fashion, the upper and lower baskets are engaged so as to prevent relative longitudinal and lateral movement between the baskets.

To disengage the baskets shown in FIG. 3, it is merely necessary to separate the baskets by exerting upward force on the basket situated on top, while holding the lower basket. This effectively causes the arch 46 of the lower basket 48 to disengage from the frame 40 and the gripper bar 42 of the upper basket 44.

Figure 4:
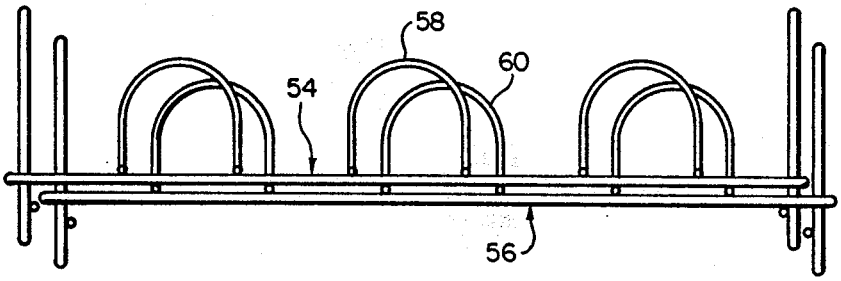
FIG. 4 is a side elevational view of a plurality of baskets being nested with respect to one another.

FIG. 4 shows the basket 54 nesting in the basket 56. Baskets 54 and 56 would occupy the top and bottom positions respectively in a stacked configuration shifting slightly basket 54 in a longitudinal or lateral direction with respect to basket 56. The nesting configuration arises easily upon disengaging the basket 54 from the basket 56 and then dropping the basket 54 into the lower basket 56 to realize the nesting relationship. The loops 58 and 60 of the baskets 54 and 56 aid in attaining the nesting configuration in that they act as a guide means for positioning the baskets. The loops 58 and 60 do not interfere with the free nesting of the trays because in the nesting position the loops 58, associated with the upper tray 54, are slightly offset from the loops 60 of the lower tray 56.

It will be appreciated that the improved basket of the present invention is advantageous in many respects. The top and ends of the basket are open and free from interfering cross support elements, and therefore the basket is easily accessible for loading and unloading of correspondences, computer programs, date sheets, and other materials. The present invention thus simplifies loading and unloading of these materials and additionally, offers a means whereby the baskets are easily stacked and nested.

The improved stacking mechanism, utilizing both the frame of the baskets as well as a gripping bar, enables the baskets to be held securely in a stacked relationship without the need for any further additional support. Lastly, the improved basket is extremely rigid and rugged in its construction, and is relatively easy and inexpensive to manufacture.

The above detailed description has been given for ease of understanding only. Unnecessary limitations are to be understood therefrom, as modifications will be obvious to those skilled in the art.

I claim:

1. A basket suitable for stacking and nesting with like baskets comprising a bottom, defined by a frame and first wire means extending from front to back across said frame and affixed thereto; arch members, each arch member consisting of continuous wire members having an extreme upper portion, an intermediate center portion and two feet, said arch members affixed to the frame at opposite edges of said frame in parallel orientation with said first wire means, such that both said upper and center portions of said arch members extend above said frame and said two feet extend below said frame, said first wire means being spaced inwardly from said arch members to provide respective inner openings at both edges of said frame whereby an upper like basket would nest within said basket longitudinally offset, the feet of one of said arch member of said upper basket being accommodated by the opening at one edge of said basket, the opening at the opposite inner edge of said upper basket accommodating the upper portion of said arch member of said basket; and means for stacking said basket with said upper basket whereby said center portions of said arch members of said upper basket rest upon and are in superior register with the upper portions of said arch members of said basket.

2. A basket as described in claim 1 wherein said means for stacking the baskets further comprises means for gripping stacked baskets, said means for gripping stacked basket affixed to said arch member so as to define a receiving space between said frame and said means for gripping stacked basket, said space being suitable for securely receiving said upper portion of said arch member of a like basket situated beneath said basket in a stacked relationship.

3. A basket as described in claim 2 wherein said means for gripping stacked baskets comprises a gripping bar affixed to said arch member and positioned below said frame.

4. A basket as describe in claim 2 wherein said first wire means is upraised at the back of said frame.

5. A basket as described in claim 4 wherein said arches are affixed to the inside of said frame.

6. A basket as described in claim 4 wherein said frame is rectangular.

7. A basket structure comprising substantially similar upper and lower baskets, said upper baskets being above said lower baskets in a stacked relationship, said upper and lower baskets having similar bottoms, defined by substantially rectangular shaped frames and first wire means extending from front to back across said frames and affixed thereto; arch members, each arch member consisting of continuous wire members having an extreme upper portion, an intermediate center portion and two feet affixed to two opposite ends of said frame such that both said upper and center portions of said arch members extend above said frame and said feet extend below said frame, a bar affixed to and extending across said center portion of said arch member to define a space between said frame and arch member, said space being suitable for engaging said upper portion of said arch member of said lower basket whereby said center portion of said arch member of said upper basket rests upon and is in superior register with said upper portion of said arch member of said lower basket.

8. A basket structure as defined in claim 7 further comprising second wire means upraised at one side of each respective said bottoms between said arch members to define a rear of said baskets.

9. A basket stacking device comprising a pair of arch members, each arch member consisting of a continuous wire member having an extreme upper portion, an intermediate center portion and two feet, said arch members being fastenable to opposite edges of a frame of a first basket such that both upper and center portions of said arch members extend above said frame and said feet extend below said frame, and respective gripping bars affixed near and extending across respective feet of said arch members so as to define respective spaces between said respective bars and the edges of said frame of said first basket, said spaces being suitable for securely receiving said upper portions of said arch members of a second like basket stacked beneath said first basket, whereby said center portions of said arch members of said first basket rests upon and are in superior register with said upper portions of said arch members of said second basket.

10. A basket stacking device comprising two continuous, one piece arched shaped wires having extreme ends, forming feet, upper and lower arch member and gripping bars respectively affixed near and extending across each said extreme end on one side of said arched shaped wires, said arched shaped wires with said affixed gripping bars fastened to respective ends of a frame of a first stacking basket so as to define respective spaces between said gripping bars and said frame, said spaces being suitable for receiving and firmly holding the respective upper arches of a like stacking basket, said like basket being situated beneath said first basket, the lower arch members of said first basket resting upon and being in superior register with the upper arch members of said like stacking basket.

* * * * *